United States Patent [19]

Kerz

[11] 4,019,272

[45] Apr. 26, 1977

[54] IDENTIFICATION MARKER

[76] Inventor: Phillip D. Kerz, Rte. 4, Charleston, Ill. 61920

[22] Filed: Dec. 1, 1975

[21] Appl. No.: 636,416

[52] U.S. Cl. ..... 40/316; 40/23 R

[51] Int. Cl.[2] ..... G09F 3/06

[58] Field of Search ..... 40/316, 317, 23 R, 21 R, 40/136, 19

[56] References Cited

UNITED STATES PATENTS

| | | | |
|---|---|---|---|
| 2,503,114 | 4/1950 | Kennard | 40/316 X |
| 2,929,161 | 3/1960 | Kuyk | 40/316 |
| 2,975,091 | 3/1961 | Tobey | 40/316 X |
| 3,068,600 | 12/1962 | Blanchet | 40/316 |
| 3,088,237 | 5/1963 | Plummer | 40/316 |

*Primary Examiner*—John F. Pitrelli
*Attorney, Agent, or Firm*—Paul H. Gallagher

[57] ABSTRACT

Identification marker includes a tubular sleeve of continuous or single-piece strip of material, pre-formed in helical or spiral form. The material may be plastic or metal, and is flexible and adaptable to application thereto of identifying indicia on its outer surface. It may be formed from long tubular lengths and cut to individual lengths. Its inner surface is provided with adhesive material which forms a mild bond with the article to which it is applied and to be identified, normally retaining the marker on the article, but enabling it to be removed by greater force, and applied to another article, and is effective for again normally retaining in stationary position on the other article. The material is springable to enable the marker to be removed from the article by springing it outwardly or unwinding it.

1 Claim, 7 Drawing Figures

IDENTIFICATION MARKER

OBJECTS OF THE INVENTION

A broad object of the invention is to provide an indentification marker to be applied to an article to be identified and effectively removed and re-applied to another article.

Another broad object is to provide an indentification marker of helical form that is extremely simple, can be easily fabricated or formed to fit any of various sizes and shapes of articles.

A further object is to provide a marker of the foregoing general character that is fabricated or formed form a long supply length, and cut into shorter lengths according to individual preferences.

An additional object is to provide an identification marker of the foregoing character that includes a sleeve, that is applicable to and removable from an article to be identified, having an inner layer of adhesive material for securing the marker on the article the adhesive material normally retaining the marker in position, but releasably so, for enabling removal of the marker for applying it to another article.

A further object is to provide an identification marker of the foregoing character which is of its helical or spiral tubular form, surrounds the article to be identified, and hence is not easily accidentally lost, and because of its tubular shape is unusually strong.

Still another object is to provide an identification marker of the foregoing kind which is of extremely simple construction and accordingly very economical in material and fabrication thereof.

Still another object is to provide a novel method of marking or fabricating an identification marker, and applying it to an article to be identified, and additionally enabling it to be removed and to be re-applied to other articles.

DESCRIPTION OF A PREFERRED EMBODIMENT

Figure 1:
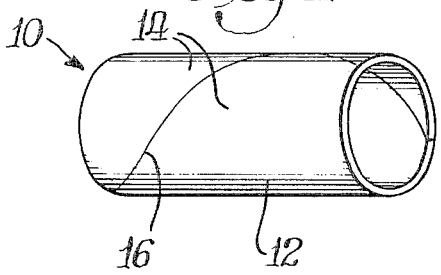
FIG. 1 is a prespective view of an identification marker made according to the present invention.

Referring in detail to the drawings, the identification marker is shown at 10 in FIG. 1. It is in the form of a tube or sleeve of helical or spiral construction formed from a continuous strip 12. The strip is pre-formed so that it normally assumes its tubular shape in the absence of unusual external forces. The helical sleeve includes turns or laps 14, a parting line 16 between the turns being shown in this figure.

The material from which the marker is made is preferably a plastic and it may be transparent and clear, or opaque, or any desired degree of translucency therebetween, and of any color. Other materials may be used instead, such as metal. Whatever the material, it is yieldable and springable and can be sprung to open position represented in FIG. 2 wherein the turns 14 are separated with a space 18 therebetween, and upon release of the spreading pressure, it contracts or springs back to normal closed tubular form.

Figure 2:
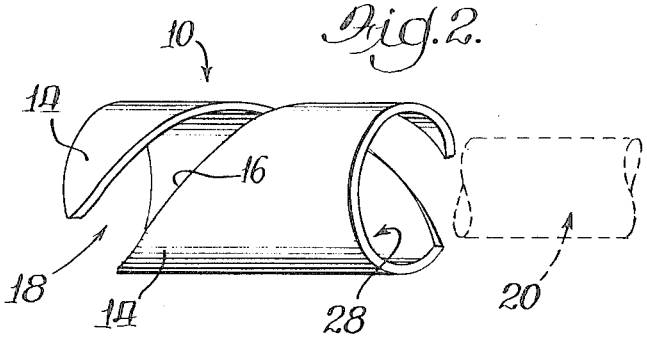
FIG. 2 is a perspective view of a marker sprung to partially open position, in association with an article to which it is to be applied.

The sleeve can be sprung to the open position of FIG. 2 by the fingers, and can when in that position be applied to an article which as here represented may be an elongated member 20, such as a rod or bar. For convenience, the term "rod" as here used is a generic reference to the article to be marked, whether a rod or bar, or other member, representing an elongated article which the marker can surround. If the rod 20 has a free end, or open end, the marker may be slid over that end, but in the event the article is a rod that does not have a free end, the sleeve or tube can be sprung to completely open position enabling it to be applied to the rod in transverse direction, and then released and the turns 14 spring back to their normal position in surrounding relation to the rod.

Figure 3:
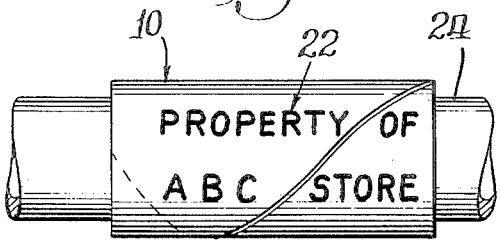
FIG. 3 is a side view of the marker applied to an article.
Figure 4:
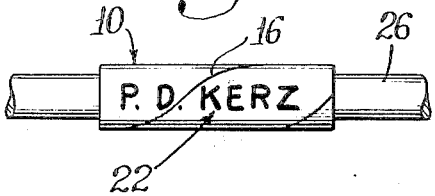
FIG. 4 is a view similar to FIG. 3 but showing a different size and different indicia of identification.

Each marker is provided with identifying indicia as represented at 22 in FIGS. 3, 4, and 6, as will be referred to again hereinbelow.

The marker in the form of the sleeve as shown in FIG. 1 in accordance with its pre-formed shape and condition assumes its closed position in which its turns 12 engage each other at their lateral edges longitudinally of the sleeve. The abutment between the turns, i.e., in the contraction of the turns, provides a degree of solidity to the sleeve, in that the abutment or engagement tends to stiffen the sleeve and impart solidity thereto. In such condition the sleeve remains in surrounding relation to the article to which it is applied and there are practically no undue forces encountered in ordinary use which would tend to dislodge it. Preferably the sleeve includes for example about 1½ or 2 turns of circumferential extent, this providing the desired solidity and firmness. Obviously it may be made longer so as to have more turns, or it may even have a lesser number of turns, if desired. The thickness of the material is not critical and may be of any thickness according to practical applications and the forces to be expected that would tend to dislodge it. Obviously the thicker the material, the less likely it will be to be accidentally dislodged.

There is practically no limit to the kinds of uses to which the marker may be put. For example, as shown in FIG. 3 the marker may have the indicia 22 referred to above as representing a store and applied to the handle 24 of a pushcart, while in FIG. 4 the marker may have the name of an individual and applied to an article 26 which may be for example a golf club.

When the marker is made of metal, a suitable spring material may be used, of sufficient strength to hold it in position, yet enabling it to be sprung by the fingers.

Many times, and probably most times, the marker will hold on the article to which it is applied such as a bar, the turns or convolutions extending several circumferential turns, but it may be desired also to utilize an adhesive material on the marker. The adhesive material may be applied to the inner surface 28 of the sleeve; FIG. 6 is a cross sectional view of a strip making up the convoluted sleeve, the strip itself being shown at 14 and a layer 30 of material applied to the inner surface 28 of the sleeve. This adhesive material may be of any desired and known kind, and is applied to the sleeve either in mastic form or as a separate self-contained inner layer secured on the inner surface of the main layer of the sleeve. In either case, the adhesive is of mild strength, and when the sleeve engages the rod 20 the adhesive material prevents the sleeve from normally being shifted or slid along the rod, although it can be shifted manually if such is desired. This shifting may be facilitated by springing the sleeve to partially open position, and the adhesive material is such that it can be separated from the rod 20 easily by opening the sleeve, i.e., by peeling the turns of the sleeve from the rod. In the normal use of the marker, if the adhesive material should fail or deteriorate, or otherwise become ineffective, the surrounding positioning remains effective for retaining the marker on the article, and although it may be possible for the marker to be shifted along the article, still it would not be lost in the normal course of events.

While the foregoing description is directed to applying the marker to a solid article such as a rod or bar, it is also within the scope of the invention to apply the marker to soft ware such as cloth,, twine, etc., but in the latter cases normally it would not be provided with adhesive material.

The marker may be of any desired size, either in length or diameter. For example, for any given diameter, the length may be as desired, including as many turns 14, or fractions of turns, to make up the desired length. Similarly in the case of different size or different diameter articles to be marked, the marker would be of the pre-selected diameter or transverse dimension according to the size of the article to be marked. Normally a marker of greater diameter would be of greater length, in order to provide the proper number of turns in the helix or spiral, but in this case also a certain number of turns may be desired regardless of the diameter of the article. Aslo the thickness of the material making up the sleeve may be varied, condideration being given to different sizes of marker, particularly the diameter thereof.

Figure 5:
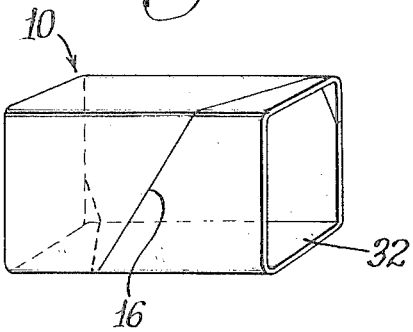
FIG. 5 is a perspective view of a marker of a different shape from that of FIG. 1.

FIGS. 1–4 represents a marker of cylindrical shape, but the marker may assume any of a wide variety of shapes, such for example as the square shape indicated at 32 in FIG. 5. Square or non-cylindrical shapes may be desired for a variety of uses, such for example furniture in an institution, sports articles, tools, etc.

As indicated in the statement of objects above, the marker may be applied first to one article and then later removed and applied to another article. Such is readily accomplished by springing the helical strip of the sleeve to open position and removing it from the article and then applying it to another article in the manner referred to above. Thus the identification marker is very adaptable to use, and this method step constitutes an important feature of the invention.

Figure 7:
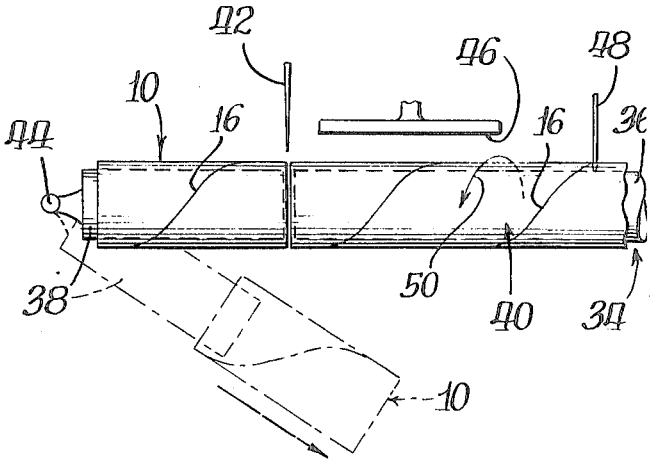
FIG. 7 is a perspective view representing steps in the forming of individual markers.

The invention is also well adapted to a convenient method of making it. FIG. 7 represents steps in making the indentification marker. Mandrel means 34 is provided having a fixed main section 36 and a swingable short section 38. A long continuous length 40 of helical, tubular material is slid outwardly over the main section 36 and onto the short section 38 thereof. Cutting means 42 is provided which cuts the helix forming a short length which constitutes the individual marker 10 identified above. The short section 38 of the mandrel may be pivoted at 44 so that after the long continuous length has been cut, the short section 38 can be swung down to dotted line position so that the short length 10, or markers, can slide off.

FIG. 7 also includes means for imprinting the identification 22. A die 46 is provided with elements for imprinting the indicia on the long section. This indicia may extend beyond the line 16 onto two or more turns 14, the placement and length of the intervals of the indicia being according to the desired length of sleeve 10 cut therefrom. Thus the formation of the short sleeve or marker may be a continuous series of steps, placing the indicia thereon and cutting the short lengths therefrom.

Figure 6:
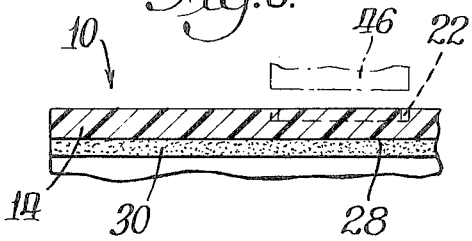
FIG. 6 is a cross sectional view of a strip of the material making up the marker.

Preferably the indicia 22 is pressed into the material of the sleeve, in intaglio form or below the surface thereof, as represented in FIG. 6, and as distinguished from embossment, so that the indicia will not wear off from continued use.

It is also encompassed within the invention to utilize in the beginning, uncut tubing, and slit it by a knife 48 to produce the helical form. Suitable means is provided for feeding the tubing longitudinally and at the same time rotating it as indicated by the arrow 50.

The identification markers may be supplied on individual order, being fabricated and formed according to the individual's needs, or pre-formed in quantity for filling orders in the aggregate.

I claim:

1. An identification marker for application to an elongated article in the form of a rod, comprising, a tubular sleeve of polygonal cross section made of a strip of flexible pre-stressed spring material having helical turns normally in contracted condition of pre-formed shape with adjacent turns in edge-to-edge inter-engaging relation and thereby forming an axially and circumferentially continuous tube, the turns being flexible outwardly by the fingers of the user to a relatively large-diameter condition of the sleeve, and further flexible to an open position in which the turns provide an open side extending longitudinally, to enable the sleeve to be applied to and removed from the article in transverse direction, and upon release of pressure for opening the turns, the turns return to contracted condition in surrounding relation to the rod, the sleeve when on a rod of a first diameter no greater than the internal side-to-side dimension of the sleeve, being in fully contracted condition in which the adjacent turns inter-engage, the sleeve including substantially more than a single turn, whereby to enable the sleeve to be flexed outwardly and spread to a substantially increased transverse size to surround a rod of substantially greater diameter than said first diameter with the turns completely surrounding the rod, and there thus being no portion of the rod circumferentially that is not surrounded by the sleeve, the turns due to their helical positioning being each in full gripping engagement with the rod at points throughout the full circumferential extent of itself and of the rod and thereby performing its full incremental part in holding the marker on the rod, the turns being in such full gripping engagement in the case of rods of any diameter throughout a wide range including said first diameter as the smallest, the sleeve being constituted solely by said turns whereby the marker does not include any portions extending axially beyond the ends of the marker itself and the marker is thereby held on the rod solely by the engagement of the turns with the rod, the turns being free of all mechanical interconnection, and the sleeve being provided with identification indicia in intaglio form on its outer surface.

* * * * *